United States Patent [19]

Pugnet

[11] Patent Number: 4,570,706

[45] Date of Patent: Feb. 18, 1986

[54] DEVICE FOR HANDLING RODS FOR OIL-WELL DRILLING

[75] Inventor: Gérard Pugnet, la Chapelle sur Erdre, France

[73] Assignee: Alsthom-Atlantique, Paris, France

[21] Appl. No.: 475,564

[22] Filed: Mar. 15, 1983

[30] Foreign Application Priority Data

Mar. 17, 1982 [FR] France ..... 82 04506

[51] Int. Cl.[4] ..... E21B 19/07; B25B 17/00

[52] U.S. Cl. ..... 166/77.5; 175/162; 173/164; 81/57.16; 81/57.18; 81/57.19; 81/57.21; 81/57.34

[58] Field of Search ..... 166/77.5, 78, 85; 175/162, 170, 202, 203; 81/57.16, 57.18, 57.19, 57.21, 57.34; 29/240; 173/164

[56] References Cited

U.S. PATENT DOCUMENTS

| | | | |
|---|---|---|---|
| 3,776,320 | 12/1973 | Brown | 81/57.18 |
| 3,877,529 | 4/1975 | Litchfield | 166/77.5 |
| 3,915,244 | 10/1975 | Brown | 166/77.5 |
| 3,921,473 | 11/1975 | Boyadjieff et al. | 81/57.21 |
| 3,957,113 | 5/1976 | Jones et al. | 166/77.5 |
| 4,015,661 | 4/1977 | Christensen | 166/77.5 |
| 4,309.922 | 1/1982 | Beckley et al. | 81/57.19 |
| 4,348,920 | 9/1982 | Boyadjieff | 166/77.5 |

*Primary Examiner*—Stephen J. Novosad
*Assistant Examiner*—William P. Neuder
*Attorney, Agent, or Firm*—Sughrue, Mion, Zinn, Macpeak & Seas

[57] ABSTRACT

A device for handling rods for oil-well drilling, said device having a motor (21) associated with a reduction gear (22), the motor being suspended from a hook (8) and rotating a hollow vertical shaft (20) about its axis, said shaft being connected to a drilling sludge inlet pipe, wherein around said shaft is disposed a jack which has a cylinder (26) integral with the shaft and an annular piston (24) which is rotated with the shaft and which can undergo translation movements parallel to said axis, said piston (24) inside the cylinder (26) is extended outside the cylinder by a tubular end piece (33) which has a screw thread at its lower portion so as to be able to screw onto a drilling rod, the device further including a set of retractable claws (42) and a set of shoes (44) which allow the first set of rods to be both supported and held motionless, said set of claws and of shoes being guided so that they come into contact with guide units (41B, 43B) which are prevented from rotating and are connected to a housing (35) which protects the assembly fixed at its upper portion to the assembly formed by the motor (21) and the reduction gear (22), said assembly being prevented from rotating by a connection system having a jack (9) and a connecting rod (100) which allow a sideways movement of the device as a whole and connect it to a carriage (10) which slides along stationary vertical tracks (11).

4 Claims, 3 Drawing Figures

DEVICE FOR HANDLING RODS FOR OIL-WELL DRILLING

The present invention relates to a device for drilling wells and in particular oil-wells in an installation in which the drive system for rotating the rods hangs directly under a suspension hook.

In such installations, installing the drilling rods sometimes requires dangerous manual operations.

Preferred embodiments of the invention avoid the neccesity of any manual operation.

They also provide a device which provides automatic compensation for variation in the length of the rod set due to unscrewing or screwing during drilling operations.

SUMMARY OF THE INVENTION

The invention provides a device for handling rods for oil-well drilling, said device having a motor associated with a reduction gear, the motor being suspended from a hook and rotating a hollow vertical shaft about its axis, said shaft being connected to a drilling sludge inlet pipe, wherein around said shaft is disposed a jack which has a cylinder integral with the shaft and an annular piston which is rotated with the shaft and which can undergo translation movements parallel to said axis, said piston inside the cylinder is extended outside the cylinder by a tubular end piece which has a screw thread at its lower portion so as to be able to screw onto a drilling rod, the device further including a set of retractable claws and a set of shoes which allow the first set of rods to be both supported and held motionless, said set of claws and of shoes being guided so that they come into contact with guide units which are prevented from rotating and are connected to a housing which protects the assembly fixed at its upper portion to the assembly formed by the motor and the reduction gear, said assembly being prevented from rotating by a connection system having a jack and a connecting rod which allow a sideways movement of the device as a whole and connect it to a carriage which slides along stationary vertical tracks.

Preferably, the hollow shaft and the annular piston have vertical splines which prevent the piston from rotating about the shaft.

Advantageously, a valve is interposed between the annular piston and the tubular end piece.

BRIEF DESCRIPTION OF THE DRAWINGS

An embodiment of the invention is described with reference to the accompanying drawings in which.

MORE DETAILED DESCRIPTION

Figure 1:
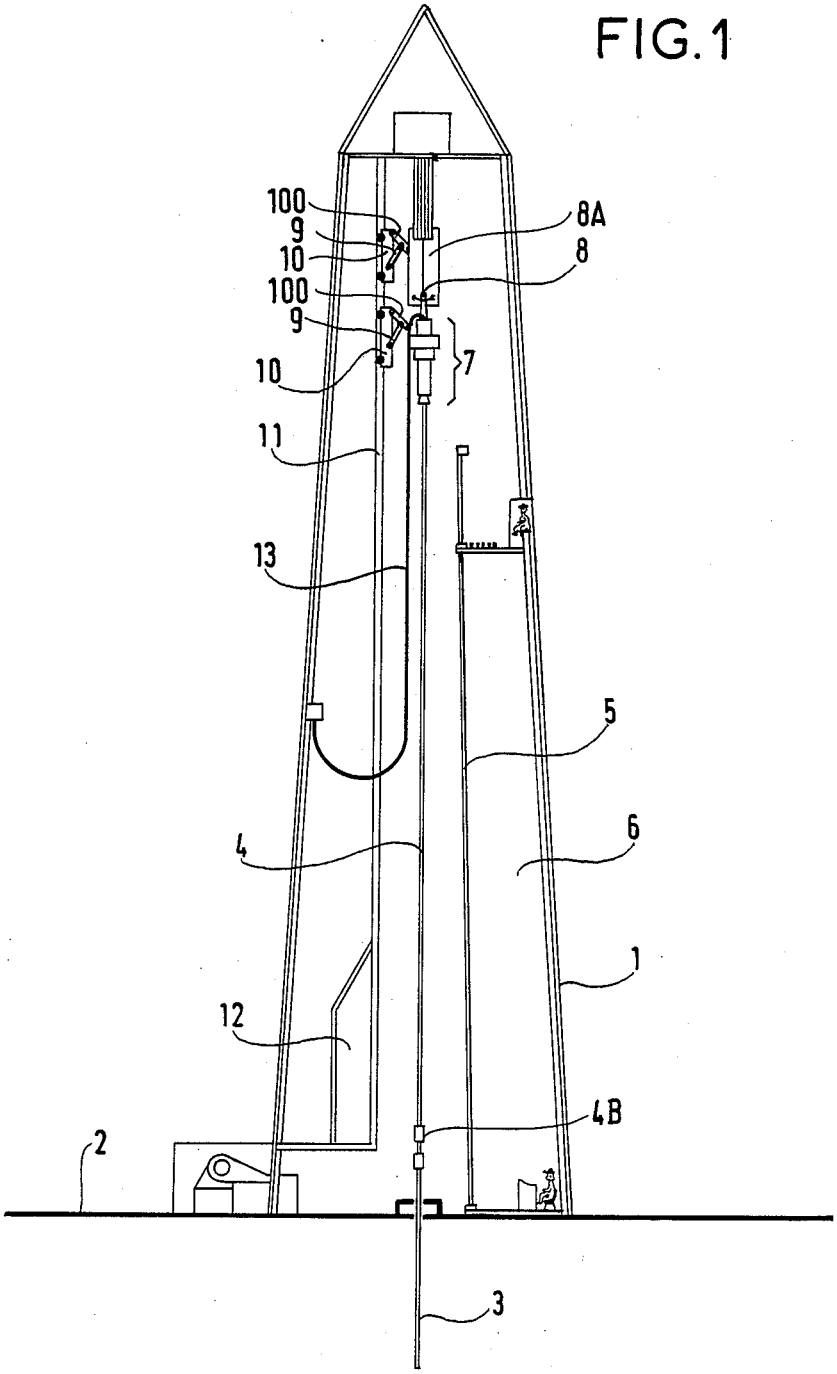
FIG. 1 is a general view of a derrick equipped with a rod-handling device in accordance with the present invention.

FIG. 1 is a general view of a derrick for drilling oil-wells.

In said figure, the structure of the derrick 1 is erected on ground 2. A first set 3 of rods is to be extended by a second set 4 of rods (said second set being constituted by three rods, for example) which are preassembled by means of the device in accordance with the invention.

The device also enables a rod or a set of rods 4 to be detached from a set of rods 3. Spare preassembled second sets of rods such as 5 are stored vertically in a zone 6; the rod drive and handling device 7 is suspended from a hook 8 placed at the top of the derrick, the hook itself being fixed to a pulley block 8A.

Further, the drive and handling device 7 and the straps of the pulley block 8A are fixed by means of jacks 9 and connecting rods 100 to carriages 10 movable along stationary vertical tracks 11. Said connection prevents rotation of the device 7.

This enables the device to move vertically or horizontally and even to be stored in a storage zone 12.

Lastly, FIG. 1 shows a drilling sludge inlet pipe 13.

Figure 2:
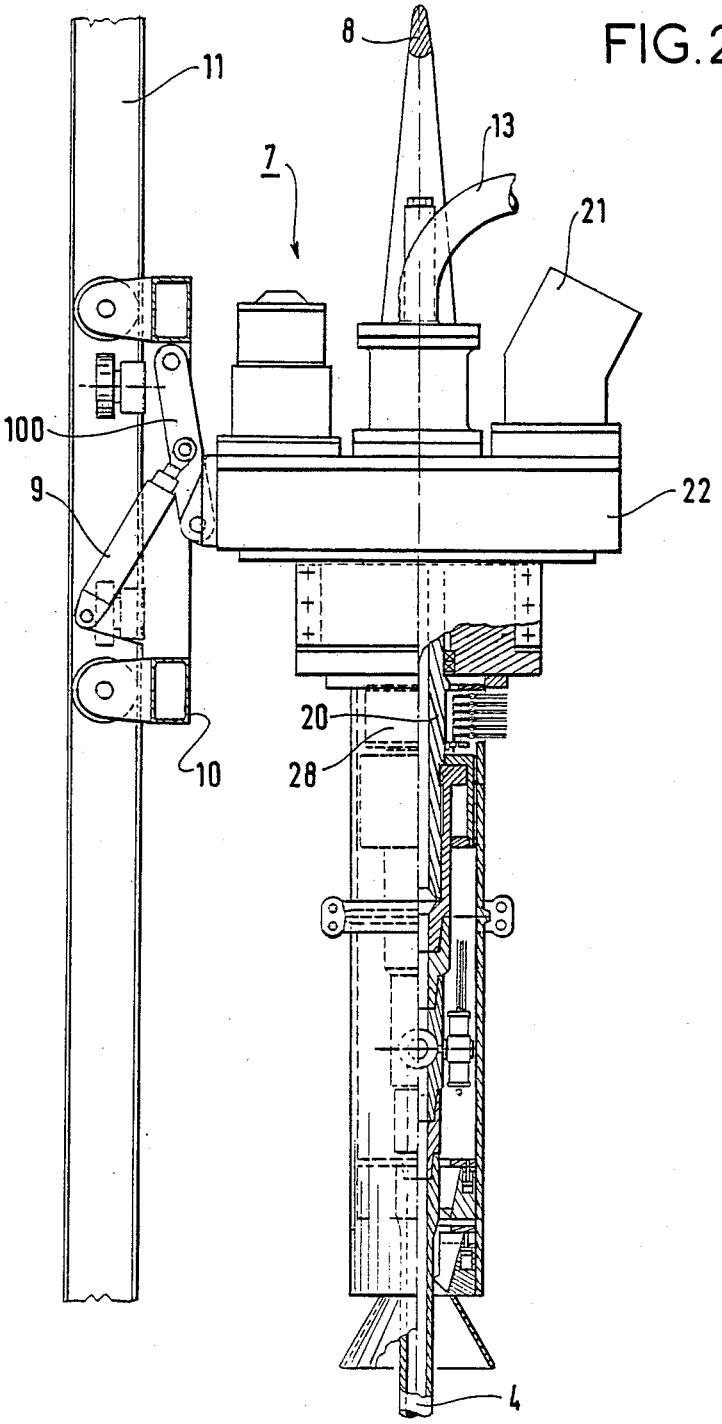
FIG. 2 is an elevation partially in crosssection of the handling device in accordance with the invention.
Figure 3:
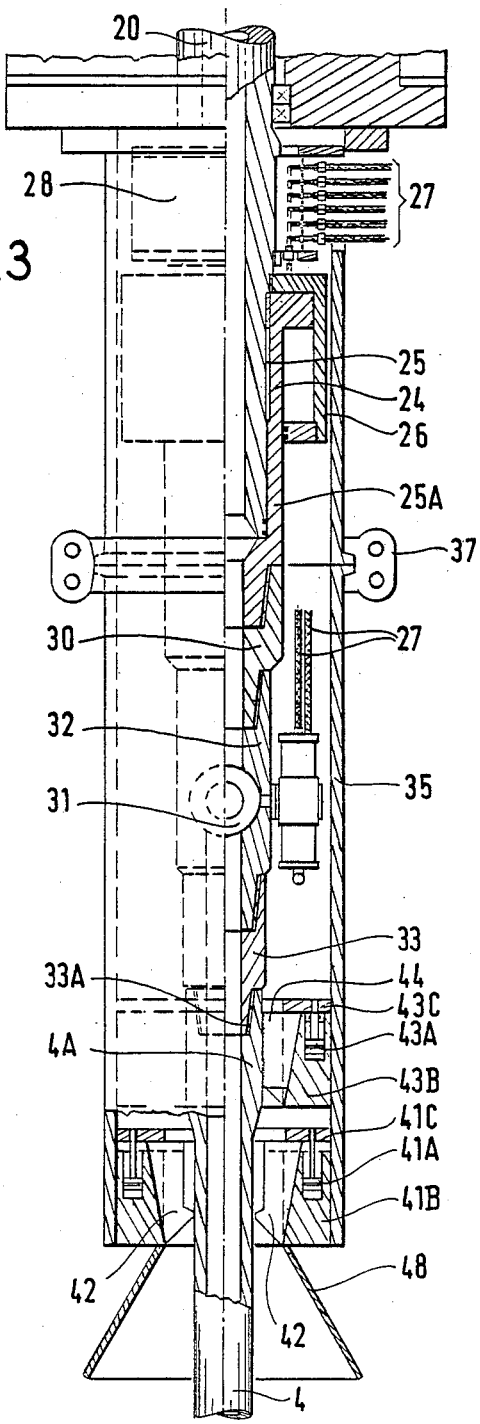
FIG. 3 is an enlarged view of a portion of the device of FIG. 2.

With reference to FIGS. 2 and 3, the device has a hollow shaft 20 rotated by a motor 21, preferably a hydraulic motor. The sludge in the pipe 13 passes along the inside of the shaft 20.

The rectangle 22 represents a speed reduction gear of known type which is not part of the invention and which it is not necessary to describe in detail.

The handling device includes a cylinder 26 fixed to the shaft 20 and a rotating jack constituted by an annular piston 24 which can be rotated with the hollow shaft 20 and can move in translation parallel to the axis of the shaft.

The annular piston has splines 25 which are parallel to the axis of the shaft, said shaft having corresponding splines. Said double set of splines thus allows the abovementioned movements.

The translation movements of the piston as well as the movements of the parts which are described hereinafter are hydraulically controlled by means of oil pipes 27 which enter a movable unit 24, 25, 26 via a rotating seal 28.

The piston 24 inside the cylinder 26 is extended by a hollow rod 25A located outside said cylinder 26, said hollow rod 25A being fixed to a hydraulically-controlled ball cock 31 by means of a fitting 30. Said ball cock 31 is fixed to an annular support 32. It serves to control blow-backs and also prevents sludge from falling on the heads of personnel on the platform when the rods are removed.

An end piece 33 is fixed to the support 32. It has an outer thread 33A which is complementary to that inside the tool-joint 4A of the borer rod 4 which is to be handled.

The movable assembly described hereinabove is protected by a non-detachable housing 35 whose upper portion is connected to the assembly formed by the motor 21 and by the reduction gear 22 which assembly is made of a plurality of components assembled by fixing rings 37. Two assemblies equipped with jacks are fixed on said housing.

The first of these assemblies has a group of jacks whose pistons are referenced 41A and whose cylinders are referenced 41B. Each piston is extended by a part 41C to which a hook or claw 42 is fixed. The conical forms which are complementary to the hook and to the cylinder allow the hooks to come close to or move away from the axis, the cylinders 41B being fixed to the housing 35 and serving as guide units for the hooks 42.

The simultaneous movement of the hooks thus allows the first set of rods to be supported by fixing means under the tool joint 4A of the first set of rods. Advantageously, there are four jacks each of which actuates a hook.

The second assembly has a group of jacks whose pistons are referenced 43A and whose cylinders are referenced 43B. Each piston is associated with a part 43C which acts upon a shoe 44; the complementary conical shapes of the shoes and of the cylinders allow vigourous clamping on the end of the rod 4, the cylinders 43B also being fixed to the non-detachable housing 35 and acting as guide units for the shoes 44.

Advantageously, there are four jacks which act upon four shoes.

The device operates as follows when it is required to attach a new second rod set 4 to the first rod set 3 which is fixed to the ground in a motionless configuration in accordance with a known technique.

By means of the jacks 9 and of the carriages 10, the device 7 is brought above the zone 6 where the rods (or second sets of rods) are stored. The device (with the motor 21 stopped) is lowered so as to cap a rod easily by means of a cone 48 at the base of the device. When the end 4A of the assembly is engaged, the jacks 41A-41B are made to grip the assembly which can then be moved from the storage zone to a location vertically in line with the first rod set 3.

When the lower end 4B of the second rod set 4 is aligned with the first rod set 3 they are brought towards each other by lowering the device 7 by means of the pulley block 8A until the second rod set 4 comes into contact with the first rod set 3. The assembly is further lowered so that the ends 4A of the rods 4 abut against the lower end of the part 33 in such a way that the tool joint 4A lies opposite the shoes 44 and is not supported by the hooks 42.

The end 4A is then tightly locked by operating the jack 43A-43B; then the motor is started up so as to rotate the movable unit 20-24-32-33 said rotation having the effect of screwing the end 33 into the end 4A of the second rod set 4. The motor is then stopped and the end 4A is released by loosening the shoes 44 by reversing the jack 43A-43B. The motor 21 is then started up again to screw the lower end 4B of the second rod set 4 onto the first rod set 3 (see FIG. 1).

The jacks 41A-41B and 43A-43B then release the second rod set 4 and drilling may be resumed by starting up the motor 21.

The second rod sets are dismantled in an analogous manner.

The jack 24-25 has three functions:

firstly, it provides small-amplitude vertical movements as required when the ends 33 of the rods of the second rod set 4 or the second rod set 4 itself is (are) moved towards (or away from) the first rod set 3;

secondly, it allows the lengths of the threads to be compensated when screwing or unscrewing the end 33 on or off the end 4A;

thirdly, and in association with a hydraulic chamber, it damps some of the vibrations which may come up the first rod set during drilling.

The device in accordance with the invention has numerous advantages:

it is sufficiently compact to replace existing devices without raising the derrick;

it can be moved away and put in a position where it is not in the way in the case of breakdown and can be replaced by a conventional handling system;

it allows screw thread compensation and damping of vibrations;

it makes it easy to close the sludge pipes when the rods are removed;

it makes safe rapid handling of the drilling rods possible.

I claim:

1. A device for handling rods for oil-well drilling, said device comprising a motor operatively associated with a reduction gear, a hook suspending said motor, said motor rotating a hollow vertical shaft about its axis, said shaft being connected to a drilling sludge inlet pipe, the improvement wherein a jack is disposed around said shaft, said jack having a cylinder integral with the shaft, an annular piston within said cylinder, said piston being rotatable with the shaft, means for effecting translation movements of said piston parallel to said axis, said piston being extended outside the cylinder by a tubular end piece which has a screw thread at a lower portion for screwing onto a drilling rod, the device further including a set of retractable claws and a set of shoes which allow the first set of rods to be both supported and held motionless, guide units for guiding said set of claws and shoes, and means for preventing said guide units and said claw and shoes from rotating, including a housing fixed at one end to said motor and reduction gear and extending downwardly therefrom and about said guide units, means for fixedly mounting said guide units to the interior of said housing, such that said housing protects said guide units, said claws and said shoes, and said rotation prevention means further comprising a carriage which slides along stationary vertical tracks and a connection system having a jack and a connecting rod between said carriage and said reduction gear which allow a sideways movement of the device as a whole.

2. A device according to claim 1, wherein the hollow shaft and the annular piston have vertical interengaging splines which effects the piston rotation with the shaft.

3. A device according to claim 2, wherein a valve is interposed between the annular piston and the tubular end piece.

4. A device according to claim 1, wherein a valve is interposed between the annular piston and the tubular end piece.

* * * * *